US005858634A

United States Patent [19]

Wang et al.

[11] Patent Number: 5,858,634

[45] Date of Patent: Jan. 12, 1999

[54] PHOTOGRAPHIC ELEMENT CONTAINING POLYMERIC PARTICLES MADE BY A MICROSUSPENSION PROCESS

[75] Inventors: Yongcai Wang, Penfield; Dennis E. Smith, Rochester; Alfred B. Fant, Rochester; John L. Muehlbauer, Rochester, all of N.Y.

[73] Assignee: Eastman Kodak Company, Rochester, N.Y.

[21] Appl. No.: 879,059

[22] Filed: Jun. 19, 1997

[51] Int. Cl.[6] ..... G03C 1/815; G03C 1/89; G03C 1/76

[52] U.S. Cl. ..... 430/527; 430/512; 430/536; 430/537; 430/627; 430/628; 430/961

[58] Field of Search ..... 430/527, 536, 430/537, 539, 627, 628, 961

[56] References Cited

U.S. PATENT DOCUMENTS

| | | | |
|---|---|---|---|
| 4,203,716 | 5/1980 | Chen | 430/545 |
| 4,203,769 | 5/1980 | Guestaux | 430/631 |
| 4,237,194 | 12/1980 | Upson et al. | 428/424.2 |
| 4,272,616 | 6/1981 | Kishimoto | 430/529 |
| 4,304,769 | 12/1981 | Chen | 424/218 |
| 4,368,258 | 1/1983 | Fujiwhara et al. | 430/546 |
| 4,542,095 | 9/1985 | Steklenski et al. | 430/527 |
| 4,582,781 | 4/1986 | Chen et al. | 430/527 |
| 4,610,955 | 9/1986 | Chen et al. | 430/527 |
| 4,916,011 | 4/1990 | Miller | 430/527 |
| 5,340,676 | 8/1994 | Anderson et al. | 430/527 |
| 5,455,320 | 10/1995 | Muehlbauer et al. | 526/207 |
| 5,492,960 | 2/1996 | Muehlbauer et al. | 524/457 |
| 5,536,628 | 7/1996 | Wang et al. | 430/531 |
| 5,563,226 | 10/1996 | Muehlbauer et al. | 526/173 |
| 5,709,986 | 1/1998 | Smith et al. | 430/536 |

*Primary Examiner*—Richard L. Schilling
*Attorney, Agent, or Firm*—Carl F. Ruoff

[57] ABSTRACT

The present invention is a photographic element which includes a support, at least one silver halide emulsion layer; and at least one layer containing a binder and polymer particles. The polymeric particles are prepared by the process of mechanically forming droplets having a size less than 400 nm of an ethylenically unsaturated monomer having hydrophobic groups, the hydrophobic groups having a $\log P_{(calc)}$ greater than a $\log P_{(calc)}$ of the ethylenically unsaturated monomer by at least 1 unit, and polymerizing said droplets so that the polymerized droplets have a size of less than 400 nm. The present invention also is a photographic element which includes a support, at least one silver halide emulsion layer; and at least one layer containing a binder and polymer particles. The polymeric particles are prepared by the process of mechanically forming droplets having a size less than 400 nm of an ethylenically unsaturated monomer having a $\log P_{(calc)}$ greater than 4, preferably greater than 6, and polymerizing said droplets so that the polymerized droplets have a size of less than 400 nm.

26 Claims, No Drawings

PHOTOGRAPHIC ELEMENT CONTAINING POLYMERIC PARTICLES MADE BY A MICROSUSPENSION PROCESS

CROSS REFERENCE TO RELATED APPLICATIONS

This application relates to commonly assigned copending application Ser. No. 08/879,060 pending filed simultaneously herewith and hereby incorporated by reference for all that it discloses. This application relates to commonly assigned copending application Ser. No. 08/879,062 pending filed simultaneously herewith and hereby incorporated by reference for all that it discloses. This application relates to commonly assigned copending application Ser. No. 08/878,791 pending filed simultaneously herewith and hereby incorporated by reference for all that it discloses. This application relates to commonly assigned copending application Ser. No. 08/879,718 pending filed simultaneously herewith and hereby incorporated by reference for all that it discloses.

FIELD OF THE INVENTION

This invention relates to method of making uniformly sized polymer particles for use in photographic elements. More particularly, the present invention provides polymer particles of less than 400 nm which can be made reproducibly, are compatible with gelatin, do not coagulate when contained in a coating solution, and do not generate spot defects which are harmful to the physical performance of the photographic elements.

BACKGROUND OF THE INVENTION

It is known to use synthetic polymer particles in silver halide photographic elements to improve physical characteristics. In particular, polymer particles from 0.5 $\mu$m (500 nm) to 10 $\mu$m have found wide use as matting agents in an element to increase the surface roughness so as to reduce self-adhering of the material, to reduce sticking of the material to manufacturing and processing devices, to improve the antistatic properties of the material, and to improve the vacuum adhesiveness of the material in contact exposure to prevent Newton's rings. Polymer particles smaller than 500 nm obtained by emulsion polymerization technique (polymer latex particles) have found wide use as replacements for gelatin. For example, it has been proposed to use polymer latex particles in both hydrophilic light sensitive layers and hydrophilic light insensitive layers to improve the element dimensional stability, to improve element drying characteristics during photographic processing, to improve layer adhesion and flexibility, to reduce pressure fog, to control dye and image stability, to carry photographically useful compounds such as dyes, couplers, accelerators, hardeners, etc., and to improve the scratch and abrasion resistance of the layer, in particular the surface protective layer.

Many techniques for synthesizing matting agents have been disclosed. Most commonly, a suspension polymerization technique is used. U.S. Pat. No. 5,492,960, for example, describes a microsuspension polymerization process to make polymer particles larger than 1000 nm. Polymer particles smaller than about 1000 nm, and especially smaller than about 500 nm, are typically made by emulsion polymerization. The resultant particle slurry is called latex. In emulsion polymerization, ethylenically unsaturated monomers are added to an aqueous phase which contains surfactant above the critical micelle concentration and a water-soluble initiator. The mechanism of the polymerization process has been the subject of much research and is generally agreed to include emulsification of monomer into a continuous aqueous phase to form monomer droplets having a size of about 1 to 10 $\mu$m and diffusion of the monomer from the monomer droplets into surfactant micelles where the actual polymerization proceeds. Homogeneous nucleation will also occur for recipes with low surfactant concentration or monomers of relatively high water solubility, but polymerization in the monomer droplets is deemed insignificant. Thus, monomer droplets are formed to a size much larger than the resultant polymer particles and function solely as reservoirs holding the monomer until it diffuses into the growing micelles where the free radical polymerization takes place.

A conventional emulsion polymerization process prepares particles having a size and size distribution very sensitive to the type and amount of surfactant, initiator concentration, and decomposition kinetics. It does not allow a direct control of particle size and size distribution by control of monomer droplet size and distribution.

Polymer latex particles made by emulsion polymerization are typically electrostatically stabilized by using anionic surfactants. Some of the charges on the polymer particle surface may also come from the water soluble initiators used. Colloidal particles which are solely electrostatically stabilized are known to be destabilized by the presence of ions such as those in coating solutions. This is particularly so for coating solutions used to form photographic elements. It is very common to include in photographic elements various addenda, such as salts, sensitizing dyes, surfactants, thickeners, inorganic fillers, etc. The presence of these compounds in coating solutions significantly reduces the stability of polymer latex particles by reducing the electrostatic repulsion force from the interaction between electrical double layers or surface charges on the particles. Surfactants or sensitizing dyes may carry opposite charges to those on the polymer particle surface leading to latex particle flocculation through charge neutralization. This can have a significant impact on manufacturing processes such as filtering and delivering of the coating solutions. The efficiency of the coating process is therefore reduced.

In the manufacturing of photographic products, gelatin is widely used as a binder and, in solution, as a medium for the preparation of coating melts. Conventional lime-processed gelatin typically contains a significant amount of calcium ion concentration. Polymer latexes are greatly destabilized when added to coating solutions comprising gelatin, which results in manufacturing difficulties for making such coating compositions.

It is known to use sulfonic acid containing monomers in latex particles to improve the latex stability and compatibility with gelatin. However, the latexes are also known to cause coating solution viscosity increase, and degrade film physical properties such as ferrotyping resistance at high temperature and relative humidities. It is also known to prepare latex polymer particles at high percentage solids and large particle size by using a combination of ionic and nonionic surfactants. However, some nonionic surfactants are photographically active. Some ionic surfactants can significantly impact coating solution viscosity.

Recent patents have disclosed loaded latex dispersions, e.g. in which a photographically useful compound such as a coupler is loaded into the latex polymer particle. The usual procedure for preparing loaded latexes as described in US Pat. Nos. 4,203,716, 4,304,769, and 4,368,258 is to combine a solution of the photographically useful compounds in a water miscible organic solvent with the aqueous latex. The resulting mixture, which typically has about a 1:1 ratio of water to organic solvent, is diluted with water and organic solvent is removed by evaporation. Removing the water miscible solvent subsequent to loading apparently requires large scale processing equipment and lengthy processing times, which increases the expenses.

U.S. Pat. No. 5,536,628 describes a process for incorporating absorbing dyes into a pre-formed latex polymer particle. In the process a polymer latex of known solids is heated with stirring to 70 to 80 degree C. The absorbing dye is heated until it reaches its liquid state and is mixed with the polymer latex at high shear to generate an emulsion. The emulsion is then passed through a high energy homogenizer at least once to form an absorbing dye impregnated latex polymer dispersion.

The processes described above can result in incomplete loading which leaves, for example, residual dyes in the aqueous phase, which can then crystallize or form large oil droplets during storage generating coating spot defects.

The present invention provides photographic elements containing polymer particles smaller than 400 nm where the size of the polymer particles can be reproduced from run to run, where compatibility with gelatin is improved and where incorporation of photographically useful addenda is facilitated.

SUMMARY OF THE INVENTION

The present invention is a photographic element which includes a support, at least one silver halide emulsion layer; and at least one layer containing a binder and polymer particles. The polymeric particles are prepared by the process of mechanically forming droplets having a size less than 400 nm of an ethylenically unsaturated monomer having hydrophobic groups, the hydrophobic groups having a $\log P_{(calc)}$ greater than a $\log p_{(calc)}$ of the ethylenically unsaturated monomer by at least 1 unit, and polymerizing said droplets so that the polymerized droplets have a size of less than 400 nm.

The present invention also is a photographic element which includes a support, at least one silver halide emulsion layer; and at least one layer containing a binder and polymer particles. The polymeric particles are prepared by the process of mechanically forming droplets having a size less than 400 nm of an ethylenically unsaturated monomer having a $\log P_{(calc)}$ greater than 4, preferrably greater than 6, and polymerizing said droplets so that the polymerized droplets have a size of less than 400 nm.

DETAILED DESCRIPTION OF PREFERRED EMBODIMENT

In accordance with the present invention, the polymer particles are prepared by the process of mechanically forming oil-in-water droplets having a mean size of less than 400 nm preferably less than 250 nm, where the droplets comprise an ethylenically unsaturated monomer and a compound having a higher $\log P_{(calc.)}$ value than the monomer by at least one unit; or an ethylenically unsaturated monomer having a $\log P_{(calc.)}$ value greater than 4, preferably greater than 6; and polymerizing the oil-in-water droplets using a free radical initiator to form solid polymer particles having a mean size essentially same as the oil-in-water droplets.

The process of the instant invention differs from traditional suspension and emulsion polymerization. In traditional suspension polymerization, a polymerizable liquid is dispersed as droplets in a continuous aqueous medium and polymerized under continuous agitation. Normally, this process is carried out in the presence of a "granulating agent", such as a lyophilic polymer (starch, natural gums, polyvinyl alcohol, or the like) or an insoluble fine powder such as calcium phosphate. These granulating agents help to obtain a dispersion of droplets of the polymerizable liquid but do not provide sufficient stabilization of the dispersion so that the dispersed droplets are stable in the absence of agitation. Therefore, in the suspension polymerization method, it is necessary to carry out the polymerization under continuous high energy mechanical agitation, since otherwise extensive coalescence of the droplets will occur, with separation of a bulk phase of water-immiscible, polymerizable material or the formation of large amounts of coagulum. Because the process depends on the details of the shear field in the reactor and on the changing viscosity of the polymerizing dispersed phase, it is difficult to control reproducibly, it is not readably scaleable, and it gives broad particle size distributions (PSD).

In conventional emulsion polymerization, on the other hand, ethylenically unsaturated monomers are added to an aqueous phase which contains surfactant above the critical micelle concentration and a water-soluble initiator. The mechanism of the polymerization process has been subject of much research and is generally agreed to include emulsification of monomer into a continuous aqueous phase to form monomer droplet having a size of about 1 to 10 $\mu$m and diffusion of the monomer from the monomer droplets into surfactant micelles where the actual polymerization proceeds. Homogeneous nucleation will also occur for recipes with low surfactant concentration or monomers of relatively high water solubility, but polymerization in the monomer droplets is deemed insignificant. Thus, monomer droplets are formed to a size much larger than the resultant polymer particles and function solely as reservoirs holding the monomer until it diffuses into the growing micelles.

Particles prepared by conventional emulsion polymerization process have a size and size distribution very sensitive to the type and amount of surfactant concentration, initiator concentration, and decomposition kinetics. It does not allow a direct control of particle size and size distribution by control of monomer droplet size and distribution.

The preparation of polymer particles in accordance with the present invention involves dispersing the water-insoluble monomer in the presence of a dispersion stabilizer or granulating agent to the desired size by using a mechanical shearing device such as an agitator, a high pressure homogenizer, colloid mill, an ultrasonic horn or the like, and carrying out polymerization with little or minimal stirring (only enough to prevent creaming and to provide good thermal transfer). This differs from the suspension polymerization in which the polymerization is carried out under continuous high energy mechanical agitation, since otherwise extensive coalescence of the droplets will occur, with separation of a bulk phase of water-immiscible, polymerizable material or the formation of large amounts of coagulum. For any given monomer, the energy required to form monomer droplets smaller than 400 nm is significantly greater than the energy required to form monomer droplets from 1 to 10 $\mu$m as previously described for emulsion polymerization where the monomer droplets are used as reservoirs and disappear by diffusion as the polymerization proceeds. Any of the above listed equipment, as long as it imparts sufficient shearing energy, can be used in the practice of the instant invention. Sufficient shearing energy is provided by approximately a rate of shear (or velocity gradient ) of $10^5$ $min^{-1}$ or greater, more preferably $10^6$ $min^{-1}$ or greater. By rate of shear is meant is a value obtained by dividing an absolute value of a difference of speeds of two planes by a distance between said two planes. A high pressure homogenizer operated at 1400 psi provides a rate of shear approximately equal to $6\times10^6$ $min^{-1}$ . High pressure homogenizers are preferred.

In conventional emulsion polymerization, the principal locus of particle nucleation is the aqueous phase or the monomer swollen micelles depending on the degree of water solubility of the monomers and the amount of surfactants used; lowering water solubility of monomer and higher amounts of surfactants would favor nucleation in monomer swollen micelles. Monomer droplets are only considered to act as monomer reservoirs supplying monomers to the growing polymer particles. Therefore, particle size and size distribution are very sensitive to the type and amount of surfactants, initiator concentration and decomposition kinetics, reaction temperature, comonomers, ionic strength, and impurities such as oxygen present in the reaction medium. In the polymerization process of the present invention, the polymer particles size and size distribution are controlled by controlling the monomer droplet size and distribution. The small sizes of monomer droplets generated by homogenization are principal locus of particle nucleation. The particle size and size distribution become strongly dependent on the amount of mechanical energy and shear used in the homogenization step, and less dependent on the type and amount of surfactants, and initiator concentration.

Various dispersion stabilizers or granulating agents which can be used in practice of the present invention are well known in the art, they include, for example, surfactants such as sodium dodecyl sulfate or sodium dioctylsulfosuccinate, and hydrophilic polymers, for example, polyvinyl alcohol, methyl cellulose, methyl hydroxypropyl cellulose , ethyl cellulose, sodium salt of carboxymethyl cellulose, polyacrylic acid and salts thereof, starch, gum, alginic acid, zein, casein, etc.

Polymer particles produced by the process of the present invention are required to contain hydrophobic groups in order to prevent diffusional growth of the droplets prior to polymerization. The hydrophobic group can be any compound present in the monomer droplets but preferred is a non-reactive compound. Any of the non-reactive compounds having hydrophobic properties defined in terms of $logP_{(calc)}$ as set forth in commonly owned U.S. Pat. No. 5,455,320, issued Oct. 3, 1995, may be used. $LogP_{(calc)}$ is the logarithm of the octanol-water partition coefficient calculated using Medchem version 3.54, a software package available from Medicinal Chemistry Project, Pomona College, Clairmont, Calif. The software package is well known and accepted in the chemical and pharmaceutical industries. $LogP_{(calc)}$ is a parameter which is highly correlated with measured water solubility for compounds spanning a wide range of hydrophobicity. The non-reactive hydrophobic compounds used in the present invention are either liquid or oil soluble solids. As indicated above, the non-reactive compound is more hydrophobic than the monomer or monomers and has a higher $logP_{(calc)}$ than the monomer by at least 1 unit and more preferably by 3 units. Suitable non-reactive hydrophobic compounds are those selected from the following classes of compounds, among others:

I. Saturated and unsaturated hydrocarbons and halogenated hydrocarbons, including alkanes, alkenes, alkyl and alkenyl halides, alkyl and alkenyl aromatic compounds, and halogenated alkyl and alkenyl aromatic compounds, especially those having a $LogP_{(calc)}$ greater than about 3.

II. Esters of saturated, unsaturated, or aromatic carboxylic acids containing a total of about 10 or more carbon atoms, especially those having a $LogP_{(calc)}$ greater than about 3.

III. Amides of carboxylic acids having a total of 10 or more carbon atoms, especially those having a $LogP_{(calc)}$ greater than about 3.

IV. Esters and amides of phosphorus- and sulfur-containing acids having a $LogP_{(calc)}$ greater than about 3, and other compounds of similar hydrophobicity.

Compounds of Class I include: straight or branched chain alkanes such as, for example, hexane, octane, decane, dodecane, tetradecane, hexadecane, octadecane, 2,2,6,6,9,9-hexamethyldodecane, eicosane, or triacontane; alkenes such as, for example, heptene, octene, or octadecene; substituted aromatic compounds such as, for example, octylbenzene, nonylbenzene, dodecylbenzene, or 1,1,3,3-tetramethylbutylbenzene; haloalkanes such as, for example, heptyl chloride, octyl chloride, 1,1,1-trichlorohexane, hexyl bromide, 1,1 1-dibromoundecane, and halogenated alkyl aromatic compounds such as, for example, p-chlorohexylbenzene and the like.

Compounds of Class II include: methyl laurate, butyl laurate, methyl oleate, butyl oleate, methyl stearate, isopropyl palmitate, isopropyl stearate, tributyl citrate, acetyl tributyl citrate, phenethyl benzoate, dibutyl phthalate, dioctyl phthalate, dioctyl terephthalate, bis(2-ethylhexyl) phthalate, butyl benzyl phthalate, diphenyl phthalate, dibutyl sebacate, didecyl succinate, and bis(2-ethylhexyl) azelate and the like.

Compounds of Class III include: lauramide, N-methyllauramide, N,N-dimethyllauramide, N,N-dibutyllauramide, N-decyl-N-methylacetamide, and N-oleylphthalimide and the like.

Compounds of Class IV include, for example, sulfates, sulfonates, sulfonamides, sulfoxides, phosphates, phosphonates, phosphinates, phosphites, or phosphine oxides. Particular examples include diesters of sulfuric acid, such as, for example, dihexylsulfate, didecylsulfate, and didodecylsulfate; esters of various alkyl sulfonic acids including, for example, methyl decanesulfonate, octyl dodecanesulfonate, and octyl p-toluenesulfonate; sulfoxides, including, for example, bis(2-ethylhexyl) sulfoxide; and sulfonamides, including, for example, N-(2-ethylhexyl)-p-toluenesulfonamide, N-hexadecyl-p-toluenesulfonamide, and N-methyl-N-dodecyl-p-toluenesulfonamide. Phosphorus-containing compounds include, for example, triesters of phosphoric acid such as, for example, triphenyl phosphate, tritolylphosphate, trihexylphosphate, and tris(2-ethylhexyl)phosphate; various phosphonic acid esters, such as, for example, dihexyl hexylphosphonate, and dihexyl phenylphosphonate; phosphite esters such as tritolylphosphite, and phosphine oxides such as trioctylphosphine oxide.

Representative compounds are given below, along with their $LogP_{(calc)}$ value, calculated using the above-mentioned MedChem software package (version 3.54),

| Nonreactive Compound | $LogP_{calc}$ |
|---|---|
| hexane | 3.87 |
| octane | 4.93 |
| decane | 5.98 |
| dodecane | 7.04 |

-continued

| | $LogP_{calc}$ |
|---|---|
| hexadecane | 9.16 |
| dimethylphthalate | 1.36 |
| dibutylphthalate | 4.69 |
| bis(2-ethylhexyl)phthalate | 8.66 |
| dioctylphthalate | 8.92 |
| tritolylphosphate | 6.58 |
| tris(2-ethylhexyl)phosphate | 9.49 |
| dodecylbenzene | 8.61 |
| bis (2-ethylhexyl) azelate | 9.20 |
| trioctylphosphine oxide | 9.74 |
| dinonyl phthalate | 9.98 |
| didecyl phthalate | 11.04 |
| didodecyl phthalate | 13.15 |
| 3-(4-hydroxy-3,5-di-t-butylphenyl)-propionic acid, octadecyl ester | 14.07 |
| trioctyl amine | 10.76 |
| Monomer | |
| acrylic acid | 0.16 |
| isopropyl acrylamide | 0.20 |
| β-(hydroxyethyl) methacrylate | 0.25 |
| vinyl acetate | 0.59 |
| methyl acrylate | 0.75 |
| methyl methacrylate | 1.06 |
| ethyl acrylate | 1.28 |
| ethyl methacrylate | 1.59 |
| butyl acrylate | 2.33 |
| butyl methacrylate | 2.64 |
| styrene | 2.89 |
| divinyl benzene | 3.59 |
| mixture of vinyl toluenes | 3.37 |
| 2-ethylhexyl acrylate | 4.32 |
| 2-ethylhexyl methacrylate | 4.62 |
| t-butylstyrene | 4.70 |
| lauryl methacrylate | 6.88 |
| stearyl methacrylate | 10.05 |

The hydrophobic compound is employed in an amount of at least about 0.01, preferably at least about 0.05 and most preferably at least about 0.5 percent by weight based on the weight of the monomer. Hexadecane is the preferred non-reactive compound.

The hydrophobe can also be the polymerization initiator. Especially effective are peroxides with long alkyl chains such as lauroyl peroxide which has a $logP_{(calc)}$ of 10.61. Additionally, the hydrophobe can be a chain transfer agent such as dodecanethiol which has a $logP_{(calc)}$ of 6.47, or it can be a polymerizable monomer such as lauryl methacrylate or stearyl methacrylate.

In some cases, the monomers used to form polymer particles are sufficiently hydrophobic so that another hydrophobic additive is not required. If the monomer has a $logP_{(calc)}$ is greater than 3, preferably greater than 4.5 and most preferably greater than 6, then another hydrophobic component is not required.

Suitable ethylenically unsaturated monomers which are useful to practice the present invention include, for example, the following monomers and their mixtures: alkyl esters of acrylic or methacrylic acid such as methyl methacrylate, ethyl methacrylate, butyl methacrylate, ethyl acrylate, butyl acrylate, hexyl acrylate, n-octyl acrylate, lauryl methacrylate, stearyl methacrylate, 2-ethylhexyl methacrylate, nonyl acrylate, benzyl methacrylate, the hydroxyalkyl esters of the same acids such as 2-hydroxyethyl acrylate, 2-hydroxyethyl methacrylate, and 2-hydroxypropyl methacrylate, and the nitrile and amides of the same acids such as acrylonitrile, methacrylonitrile, and butyl acrylamide, vinyl acetate, vinyl propionate, vinylidene chloride, vinyl chloride, and vinyl aromatic compounds such as styrene, t-butyl styrene, ethyl vinyl benzene, vinyl toluene, dialkyl maleates, dialkyl itaconates, dialkyl malonates, isoprene, and butadiene. Crosslinking and grafting monomers which may be used together with the foregoing monomers to crosslink the polymer particles are polyfunctional with respect to the polymerization reaction, and may include, for example, esters of unsaturated monohydric alcohols with unsaturated monocarboxylic acids, such as allyl methacrylate, allyl acrylate, butenyl acrylate, undecenyl acrylate, undecenyl methacrylate, vinyl acrylate, and vinyl methacrylate, esters of saturated glycols or diols with unsaturated monocarboxylic acids, such as ethylene glycol diacrylate, ethylene glycol dimethacrylate, triethylene glycol dimethacrylate, 1,4-butanediol dimethacrylate, 1,3-butanediol dimethacrylate, and polyfunctuional aromatic compounds such as divinyl benzene.

The polymerization process is initiated in general with free radical initiators. Free radicals of any sort may be used. Preferred initiators include persulfate, peroxides, azo compounds, and redox initiators. The amount of initiator can vary from 0.01% to 2% by the weight of monomer, but is preferably from 0.03 to 1 % by weight thereof. Organic peroxides and organic peresters include, for example, benzoyl peroxide, dichlorobenzoyl peroxide, dicumyl peroxide, di-tert-butyl peroxide, lauryl peroxide, tert-butyl peracetate, 2,5-dimethyl-2,5-di(tert-butylperoxy)hexine-3, 2,5-dimethyl-2,5-di(tert-butylperoxy)hexane, tert-butyl perbenzoate, tert-butyl perphenyl acetate, tert-butylperisobutylate, tert-butyl persecoctoate, tert-butyl perpivalate, cumyl perpivalate and tert-butyl perdiethyl acetate, and azo compounds include, for example, azobisisobutylnitrile and dimethyl azoisobutylate.

For photographic elements, it is useful to polymerize the polymer particles of the present invention in the presence of gelatin. Gelatin can be added before or after droplet formation but before completion of the polymerization reaction. It is preferred to add gelatin after the droplet formation as per U.S. Pat. No. 5,563,226.

Photographic elements can comprise various polymeric films, papers, glass, and the like, but both acetate and polyester supports well known in the art are preferred. The thickness of the support is not critical. Support thickness of 2 to 10 mils (0.002 to 0.010 inches) can be used. The supports typically employ an undercoat or subbing layer well known in the art that comprises, for example, for polyester support a vinylidene chloride/methyl acrylate/itaconic acid terpolymer or vinylidene chloride/acrylonitrile/acrylic acid terpolymer.

To form a photographically useful layer, the polymer particles of the present invention are coated together with a film binder. Any suitable binders can be used. They include hydrophilic colloids such as gelatin as well as hydrophobic polymer resin binders. The actual amount of binder and polymer particle will vary depending on the types of applications. It is preferred that the binder is coated at a weight ratio to the particle of this invention from about 1:100 to 100:1, and more preferably from 20:80 to 95:5.

Useful resin binders include polyurethanes (e.g. Neorez R960 sold by ICI), cellulose acetates (e.g. cellulose diacetate, cellulose acetate butyrate, cellulose acetate propionate), poly(methyl methacrylate), polyesters (e.g. Vitel R sold by Goodyear Tire & Rubber Co.), polyamides (e.g. Unirez sold by Union Camp, Vesamide sold by General Electric Co.), polycarbonates (e.g. Makrolon sold by Mobay Chemical Co., Lexan sold by General Electric Co.), polyvinyl acetate, and the like.

Any suitable hydrophilic binder can be used in practice of this invention, such as naturally occurring substances such as proteins, protein derivatives, cellulose derivatives (e.g.

cellulose esters), polysaccharides, casein, and the like, and synthetic water permeable colloids such as poly(vinyl lactams), acrylamide polymers, poly(vinyl alcohol) and its derivatives, hydrolyzed polyvinyl acetates, polymers of alkyl and sulfoalkyl acrylates and methacrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl sulfonic acid copolymers, vinyl imidazole copolymers, vinyl sulfide copolymers, homopolymer or copolymers containing styrene sulfonic acid, and the like. Gelatin is the most preferred hydrophilic binder.

The photographic element of the present invention can contain at least one electrically conductive layer, which can be either a surface protective layer or a sub layer. The surface resistivity of at least one side of the support is preferably less than $1\times10^{12}\Omega/\square$, more preferably less than $1\times10^{11}\Omega/\square$ at 20° C. and 20 percent relative humidity. To lower the surface resistivity, a preferred method is to incorporate at least one type of electrically conductive material in the electrically conductive layer. Such materials include both conductive metal oxides and conductive polymers or oligomeric compounds. Such materials have been described in detail in, for example, U.S. Pat. Nos. 4,203,769; 4,237,194; 4,272,616; 4,542,095; 4,582,781; 4,610,955; 4,916,011; and 5,340,676.

The coating composition of the invention can be applied by any of a number of well-know techniques, such as dip coating, rod coating, blade coating, air knife coating, gravure coating and reverse roll coating, extrusion coating, slide coating, curtain coating, and the like. The particles of this invention and the binder are mixed together in a liquid medium to form a coating composition. After coating, the layer is generally dried by simple evaporation, which may be accelerated by known techniques such as convection heating. Known coating and drying methods are described in further detail in Research Disclosure No. 308119, Published December 1989, pages 1007 to 1008.

In a particularly preferred embodiment, the imaging elements of this invention are photographic elements, such as photographic films, photographic papers or photographic glass plates, in which the image-forming layer is a radiation-sensitive silver halide emulsion layer. Such emulsion layers typically comprise a film-forming hydrophilic colloid. The most commonly used of these is gelatin and gelatin is a particularly preferred material for use in this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly (vinylpyrrolidone), and the like. The photographic elements of the present invention can be simple black-and-white or monochrome elements comprising a support bearing a layer of light-sensitive silver halide emulsion or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to emulsion layers, the elements of the present invention can contain auxiliary layers conventional in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers and the like. The support can be any suitable support used with photographic elements. Typical supports include polymeric films, paper (including polymer-coated paper), glass and the like. Details regarding supports and other layers of the photographic elements of this invention are contained in Research Disclosure, Item 36544, September 1994.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in Research Disclosure, Item 36544, September, 1994, and the references listed therein.

The photographic silver halide emulsions utilized in this invention can contain other addenda conventional in the photographic art. Useful addenda are described, for example, in Research Disclosure, Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, lightscattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetaniuides and pivalylacetanilides.

The present invention is also directed to a single use camera having incorporated therein a photographic element as described above. Single use cameras are known in the art under various names: film with lens, photosensitive material package unit, box camera and photographic film package. Other names are also used, but regardless of the name, each shares a number of common characteristics. Each is essentially a photographic product (camera) provided with an exposure function and preloaded with a photographic material. The photographic product comprises an inner camera shell loaded with the photographic material, a lens opening and lens, and an outer wrapping(s) of some sort. The photographic materials are exposed in camera, and then the product is sent to the developer who removes the photographic material and develop it. Return of the product to the consumer does not normally occur.

Single use camera and their methods of manufacture and use are described in U.S. Pat. Nos. 4,801,957; 4,901,097; 4,866,459; 4,849,325; 4,751,536; 4,827,298; European Patent Applications 460,400; 533,785; 537,225; all of which are incorporated herein by reference.

The photographic processing steps to which the raw film may be subject may include, but are not limited to the following:

1.) color developing → bleach-fixing → washing/stabilizing;
2.) color developing → bleaching → fixing → washing/stabilizing;
3.) color developing → bleaching → bleach-fixing → washing/stabilizing;
4.) color developing → stopping → washing → bleaching → washing → fixing → washing/stabilizing;
5.) color developing → bleach-fixing → fixing washing/stabilizing;
6.) color developing → bleaching → bleach-fixing → fixing → washing/stabilizing;

Among the processing steps indicated above, the steps 1), 2), 3), and 4) are preferably applied. Additionally, each of the steps indicated can be used with multistage applications as described in Hahm, U.S. Pat No. 4,719,173, with co-current, counter-current, and contraco arrangements for replenishment and operation of the multistage processor.

Any photographic processor known to the art can be used to process the photosensitive materials described herein. For instance, large volume processors, and so-called minilab and microlab processors may be used. Particularly advantageous would be the use of Low Volume Thin Tank processors as described in the following references: WO 92/10790; WO 92/17819; WO 93/04404; WO 92/17370; WO 91/19226; WO 91/12567; WO 92/07302; WO 93/00612; WO 92/07301; WO 02/09932; U.S. 5,294,956; EP 559,027; U.S. Pat. No. 5,179,404; EP 559,025; U.S. Pat. No. 5,270,762; EP 559,026; U.S. Pat. No. 5,313,243; U.S. Pat. No. 5,339,131.

The present invention is also directed to photographic systems where the processed element may be re-introduced into the cassette. These system allows for compact and clean storage of the processed element until such time when it may be removed for additional prints or to interface with display equipment. Storage in the roll is preferred to facilitate location of the desired exposed frame and to minimize contact with the negative. U.S. Pat. No. 5,173,739 discloses a cassette designed to thrust the photographic element from the cassette, eliminating the need to contact the film with mechanical or manual means. Published European Patent Application 0 476 535 A1 describes how the developed film may be stored in such a cassette.

The present invention will now be described in detail with reference to examples; however, the present invention should not limited by these examples.

EXAMPLES

Examples 1–4 illustrate that the polymer particles prepared in the presence of hydrophobe in accordance with the present invention are stable against monomer droplet growth and particle agglomeration prior to and during polymerization process.

Example 1: (Comparative)

To a beaker are added the following ingredients: 800 g methyl methacrylate, 21.6 g Aerosol OT-100 (dioctyl ester of sodium sulfosuccinic acid), and 12 g 2,2'-azobis(2,4-dimethylvaleronitrile) sold by DuPont under the trade name Vazo 52. The ingredients are stirred until all the solids are dissolved. This solution is added to 2520 g distilled water and stirred with a marine prop type agitator for 5 minutes. The mixture is passed through a Gaulin Mill operated at 3600 rpm, 0.5 gallon/minute flow and a gap of 0.01 inches. This material is then passed through a Crepaco Homogenizer operated at 5000 psi to form the final droplet size. 1000 g of the droplet dispersion is placed in a bottle with 22.75 g of a deionized gelatin. The bottle is sealed and reacted in a tumble bath at 52 degrees C. for 16 hours. The particles prepared by this process agglomerate since they do not filter through a coarse filter and 80% of the polymer is collected on the coarse filter.

Example 2: (Invention)

To a beaker are added the following ingredients: 800 g methyl methacrylate, 21.6 g Aerosol OT-100 (dioctyl ester of sodium sulfosuccinic acid), and 12 g lauroyl peroxide. The lauroyl peroxide initiator is used as hydrophobe. The ingredients are stirred until all the solids are dissolved. This solution is added to 2520 g distilled water and stirred with a marine prop type agitator for 5 minutes. The mixture is passed through a Gaulin Mill operated at 3600 rpm, 0.5 gallon/minute flow and a gap of 0.01 inches. This material is then passed through a Crepaco Homogenizer operated at 5000 psi to form the final droplet size. 1000 g of the droplet dispersion is placed in a bottle with 22.75 g of a deionized gelatin. The bottle is sealed and reacted in a tumble bath at 52 degrees C. for 16 hours. The particles prepared by this process are stable and have a mean size of 187 nm.

Example 3: (Invention)

To a beaker are added the following ingredients: 800 g methyl methacrylate, 40 g stearyl methacrylate, 21.6 g Aerosol OT-100 (dioctyl ester of sodium sulfosuccinic acid), and 12 g 2,2'-azobis(2,4-dimethylvaleronitrile) sold by DuPont under the trade name Vazo 52. Stearyl methacrylate is used as the hydrophobe. The ingredients are stirred until all the solids are dissolved. This solution is added to 2520 g distilled water and stirred with a marine prop type agitator for 5 minutes. The mixture is passed through a Gaulin Mill operated at 3600 rpm, 0.5 gallon/minute flow and a gap of 0.01 inches. This material is then passed through a Crepaco Homogenizer operated at 5000 psi to form the final droplet size. 1000 g of the droplet dispersion is placed in a bottle with 22.75 g of a deionized gelatin. The bottle is sealed and reacted in a tumble bath at 52 degrees C. for 16 hours. The particles prepared by this process are stable and have a mean size of about 93 nm.

Example 4: (Invention)

To a beaker are added the following ingredients: 800 g methyl methacrylate, 33.2 g N-dodecanethiol, 21.6 g Aerosol OT-100 (dioctyl ester of sodium sulfosuccinic acid), and 12 g 2,2'-azobis(2,4-dimethylvaleronitrile) sold by DuPont under the trade name Vazo 52. N-dodecanethiol is used as the hydrophobe. The ingredients are stirred until all the solids are dissolved. This solution is added to 2520 g distilled water and stirred with a marine prop type agitator for 5 minutes. The mixture is passed through a Gaulin Mill operated at 3600 rpm, 0.5 gallon/minute flow and a gap of 0.01 inches. This material is then passed through a Crepaco Homogenizer operated at 5000 psi to form the final droplet size. 1000 g of the droplet dispersion is placed in a bottle with 22.75 g of a deionized gelatin. The bottle is sealed and reacted in a tumble bath at 52 degrees C. for 16 hours. The particles prepared by this process are stable and have mean size of about 127nm.

Example X: (Comparative)

To a beaker are added the following ingredients: 600 g vinyl toluene, 17 g Aerosol OT-100 (dioctyl ester of sodium sulfosuccinic acid), and 8.7 g 2,2'-azobis(2,4-dimethylvaleronitrile) sold by DuPont under the trade name Vazo 52. The ingredients are stirred until all the solids are dissolved. This solution is added to 2000 g distilled water and stirred with a marine prop type agitator for 5 minutes. The mixture is passed through a Gaulin Mill operated at 3600 rpm, 0.5 gallon/ninute flow and a gap of 0.01 inches. This material is then passed through a Crepaco Homogenizer operated at 5000 psi to form the final droplet size. 1975 g of the droplet dispersion is placed in a bottle with 10 g of a deionized gelatin. The bottle is sealed and reacted in a tumble bath at 52 degrees C. for 16 hours. The particles prepared by this process are stable and have a mean size of 110 nm, but are broad and bimodal in distribution with a second peak above 1000 nm which indicates diffusional growth when using a monomer with a $\log P_{(calc)}$ of less than 4 and in the absence of hydrophobic groups.

Example Y: (Invention)

To a beaker are added the following ingredients: 600 g t-butyl styrene, 17 g Aerosol OT-100 (dioctyl ester of sodium sulfosuccinic acid), and 8.7 g 2,2'-azobis(2,4-dimethylvaleronitrile) sold by DuPont under the trade name Vazo 52. The ingredients are stirred until all the solids are dissolved. This solution is added to 2000 g distilled water and stirred with a marine prop type agitator for 5 minutes. The mixture is passed through a Gaulin Mill operated at 3600 rpm, 0.5 gallon/minute flow and a gap of 0.01 inches. This material is then passed through a Crepaco Homogenizer operated at 5000 psi to form the final droplet size. 1975 g of the droplet dispersion is placed in a bottle with 10 g of a deionized gelatin. The bottle is sealed and reacted in a tumble bath at 52 degrees C. for 16 hours. The particles prepared by this process are stable and have a mean size of about 143 nm.

Example Z: (Invention)

To a beaker are added the following ingredients: 600 g lauryl methacrylate, 17 g Aerosol OT-100 (dioctyl ester of sodium sulfosuccinic acid), and 8.7 g 2,2'-azobis(2,4-dimethylvaleronitrile) sold by DuPont under the trade name Vazo 52. The ingredients are stirred until all the solids are dissolved. This solution is added to 2000 g distilled water and stirred with a marine prop type agitator for 5 minutes. The mixture is passed through a Gaulin Mill operated at 3600 rpm, 0.5 gallon/minute flow and a gap of 0.01 inches. This material is then passed through a Crepaco Homogenizer operated at 5000 psi to form the final droplet size. 1975 g of the droplet dispersion is placed in a bottle with 10 g of a deionized gelatin. The bottle is sealed and reacted in a tumble bath at 52 degrees C. for 16 hours, The particles prepared by this process are stable and have a mean size of 274 nm, with a narrow size distribution.

Example A: (Invention)

To a beaker are added the following ingredients: 600 g stearyl methacrylate, 17 g Aerosol OT- 100 (dioctyl ester of sodium sulfosuccinic acid), and 8.7 g 2,2'-azobis(2,4-dimethylvaleronitrile) sold by DuPont under the trade name Vazo 52. The ingredients are stirred until all the solids are dissolved. This solution is added to 2000 g distilled water and stirred with a marine prop type agitator for 5 minutes. The mixture is passed through a Gaulin Mill operated at 3600 rpm, 0.5 gallon/minute flow and a gap of 0.01 inches. This material is then passed through a Crepaco Homogenizer operated at 5000 psi to form the final droplet size. 1975 g of the droplet dispersion is placed in a bottle with 10 g of a deionized gelatin. The bottle is sealed and reacted in a tumble bath at 52 degrees C. for 16 hours. The particles prepared by this process are stable and have a mean size of about 330 nm with a narrow size distribution.

Examples 5–8 illustrate that the method of preparing polymer particles in accordance with the present invention can be used to preparing photographically useful polymer particles loaded with photographically useful compounds such as ultraviolet ray absorbers.

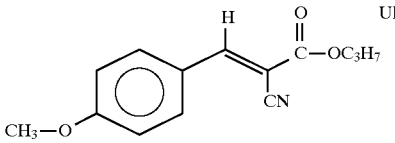

Ultraviolet Ray Absorber I

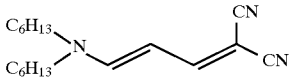

Ultraviolet Ray Absorber II

Example 5: Poly(methyl methacrylate-co-ethylene glycol dimethacrylate) particles loaded with Ultraviolet Ray Absorber I.

To a beaker are added the following ingredients: 632 g methyl methacrylate, 168 g ethylene glycol dimethacrylate, 20 g hexadecane, 266 g Ultraviolet Ray Absorber I, 28.8 g Aerosol OT-100 (dioctyl ester of sodium sulfosuccinic acid) and 16 g 2,2'-azobis(2,4-dimethylvaleronitrile) sold by DuPont under the trade name Vazo 52. The ingredients are stirred until all the solids are dissolved. This solution is added to 3360 g distilled water and stirred with a marine prop type agitator for 5 minutes. The mixture is passed through a Gaulin Mill operated at 3600 rpm, 0.5 gallon/minute flow and a gap of 0.01 inches. This material is then passed through a Crepaco Homogenizer operated at 5000 psi to form the final droplet size. 250 g of the droplet dispersion is placed in a bottle with 12.25 g of a deionized gelatin. The bottle is sealed and reacted in a tumble bath at 52 degrees C. for 16 hours. The particles prepared by this process are stable, contain 3 parts of polymer to 1 part of ultraviolet ray absorber, and have a mean size of about 182 nm.

Example 6: Poly(isobutyl methacrylate-co-ethylene glycol dimethacrylate) loaded with Ultraviolet Ray Absorber II.

To a beaker are added the following ingredients: 632 g isobutyl methacrylate, 168 g ethylene glycol dimethacrylate, 20 g hexadecane, 266 g Ultraviolet Ray Absorber II, 28.8 g Aerosol OT-100 and 16 g 2,2'-azobis( 2,4-dimethylvaleronitrile) sold by DuPont under the trade name Vazo 52. The ingredients are stirred until all the solids are dissolved. This solution is added to 3360 g distilled water and stirred with a marine prop type agitator for 5 minutes. The mixture is passed through a Gaulin Mill operated at 3600 rpm, 0.5 gallon/minute flow and a gap of 0.01 inches. This material is then passed through a Crepaco Homogenizer operated at 5000 psi to form the final droplet size. 250 g of the droplet dispersion is placed in a bottle with 6.13 g of a deionized gelatin. The bottle is sealed and reacted in a tumble bath at 52 degrees C. for 16 hours. The particles prepared by this process are stable, contain 3 parts of polymer to 1 part of ultraviolet ray absorber, and have a mean size of about 221 nm.

Example 7: Poly(n-butyl methacrylate) particles loaded with both Ultraviolet Ray Absorber I and II.

To a beaker are added the following ingredients: 600 g n-butyl methacrylate, 15 g hexadecane, 150 g Ultraviolet Ray Absorber I, 150 g Ultraviolet Ray Absorber II, 24.3 g. Aerosol OT-100 and 12 g 2,2'-azobis( 2,4-dimethylvaleronitrile) sold by DuPont under the trade name Vazo 52. The mixture is stirred until all the solids are dissolved. This solution is added to 2520 g distilled water and stirred with a marine prop type agitator for 5 minutes. The mixture is passed through a Gaulin Mill operated at 3600 rpm, 0.5 gallon/minute flow and a gap of 0.01 inches. This material is then passed through a Crepaco Homogenizer operated at 5000 psi to form the final droplet size. 2300 g of droplet dispersion is placed in a reaction flask with 56 g of a deionized gelatin. The droplets are reacted at 52 degrees C. for 16 hours. The particles prepared by this process are stable, contain 2 parts of polymer to 1 part of ultraviolet ray absorber, and have a mean size of about 182 nm.

Example 8: Poly(ethyl methacrylate) particles loaded with both Ultraviolet Ray Absorber I and II.

To a beaker are added the following ingredients: 600 g ethyl methacrylate, 16.6 g hexadecane, 200 g Ultraviolet Ray Absorber I, 200 g Ultraviolet Ray Absorber II, 27 g Aerosol OT-100 and 13.3 g 2, 2'-azobis(2,4-dimethylvaleronitrile) sold by DuPont under the trade name Vazo 52. The mixture is stirred until all the solids are dissolved. The solution is added to 2800 g distilled water and stirred with a marine prop type agitator for 5 minutes. The mixture is passed through a Gaulin Mill operated at 3600 rpm, 0.5 gallon/minute flow and a gap of 0.01 inches. This material is then passed through a Crepaco Homogenizer operated at 5000 psi to form the final droplet size. 2500 g of the droplet dispersion is placed in a reaction flask with 56 g of a deionized gelatin. The droplets are reacted at 52 degrees C. for 16 hours. The particles prepared by this process are stable, contain 1.5 parts of polymer to 1 part of ultraviolet ray absorber, and have a mean size of about 155 nm.

Examples 10–12 in Table 1 illustrate that the polymer particles prepared in accordance with the present invention have much less impact on the viscosity of coating solutions containing photographic gelatin. Coating solutions are made at 40° C. with 8% lime-processed gelatin and either 4 or 6% polymer particles. The polymer particles used in the comparative examples are made by emulsion polymerization process, and those used in the invention examples are prepared in accordance with the method of the present invention.

TABLE 1

| Solution Samples | Polymer Particle Composition and Size | Viscosity at 4% Polymer Particles | Viscosity at 6% Polymer Particles |
|---|---|---|---|
| Example 10 (Comparative) | EMA:AMPS 95/5 60 nm | 60 cps | 110 cps |
| Example 11 (Invention) | MMA:EGDM 149 nm | 22 cps | 30 cps |
| Example 12 (Invention) | MMA 104 nm | 21 cps | 30 cps |

EMA: ethyl methacrylate
AMPS: sodium 2-acrylamido-2-methylpropane sulfonate
MMA: methyl methacrylate
EGDM: ethylene glycol dimethacrylate Examples 13–16: Photographic Elements A series of photographic elements are prepared as follows: A poly(ethylene naphthalate) support is used having an antihalation layer on one side and an antistatic layer overcoated with a photographically transparent magnetic recording layer on the other side. The magnetic recording layer comprises a dispersion of colbalt-modified γ-iron oxide particles in a polymeric binder with a crosslinker and abrasive particles. The polymeric binder is a mixture of cellulose diacetate and cellulose triacetate. Total dry coverage for the magnetic layer is normally about 1.5 g/m$^2$. The support is coated on the antihalation layer side with the following imaging forming layer in sequence.

Interlayer: This layer comprises compound 2,5-di-t-octyl-1,4-dihydroxy benzene (0.075 g/m$^2$), tri(2-ethylhexyl) phosphate (0.113 g/m$^2$), and gelatin (0.86 g/m$^2$).

Slow Cyan Dye-forming Layer: This layer comprises a red sensitive silver bromoiodide emulsion (3.3 mole percent iodide) (0.324 μm grain size) (0.387 g/m$^2$ silver), compound CC-1 (0.355 g/m$^2$), IR-4 (0.011 g/m$^2$), B-1 (0.075 g/m$^2$), S-2 (0.377 g/m$^2$), S-3 (0.098 g/m$^2$), and gelatin (1.64 g/m$^2$).

Mid Cvan Dye-forming Layer: This layer comprises a blend of a red sensitive silver bromoiodide emulsion (3.3 mole percent iodide) (0.488 μm grain size) (0.816 g/m$^2$ silver) and a red sensitive, tabular grain, silver bromoiodide emulsion (4.5 mole percent iodide) (0.98 μm diameter by 0.11 μm thick) (0.215 g/m$^2$ silver), compound CC-1 (0.183 g/m$^2$), IR-3 (0.054 g/m$^2$), B-1 (0.027 g/m$^2$), CM-1(0.011 g/m$^2$), S-2 (0.183 g/m$^2$), S-3 (0.035 g/m$^2$), S-5 (0.054 g/m$^2$), and gelatin (1.35 g/m$^2$).

Fast Cyan Dye-forming Layer: This layer comprises a red sensitive, tabular grain, silver bromoiodide emulsion (4.5 mole percent iodide) (1.10 μm diameter by 0.11 μm thick) (1.08 g/m$^2$ silver), compound CC-1 (0.161 g/m$^2$), IR-3 (0.038 g/m$^2$), IR-4 (0.038 g/m$^2$), CM-1 (0.032 g/m$^2$), S-2 (0.237 g/m$^2$), S-5 (0.038 g/m$^2$), gelatin (1.35 g/m$^2$).

Interlayer: This layer comprises 2,5-di-t-octyl-1,4-dihydroxy benzene (0.075 g/m$^2$), tri(2-ethylhexyl)phosphate (0.113 g/m$^2$), and gelatin (0.86 g/m$^2$).

Slow Magenta Dye-forming Layer: This layer comprises a blend of a green sensitive, tabular grain, silver bromoiodide emulsion (1.5 mole percent iodide) (0.7 μm diameter by 0.112 gm thick) (0.258 g/m$^2$ Ag), and a green sensitive, tabular grain, silver bromoiodide emulsion (1.3 mole percent iodide) (0.54 μm diameter by 0.086 μm thick) (0.409 g/m$^2$ Ag), compound M-1 (0.204 g/m$^2$), MM-1 (0.038 g/m$^2$), ST-1 (0.020 g/m$^2$), S-1 (0.26 g/m$^2$), and gelatin (1.18 g/m$^2$).

Mid Magenta Dye-forming Layer: This layer comprises a green sensitive, tabular grain, silver bromoiodide emulsion (4.5 mole percent iodide) (0.61 μm diameter by 0.12 μm thick) (0.646 g/m$^2$ Ag), compound M-1 (0.099 g/m$^2$), MM-1

(0.027 g/m$^2$), IR-2 (0.022 g/m$^2$), ST-1 (0.010 g/m$^2$), S-1 (0.143 g/m$^2$), S-2 (0.044 g/m$^2$), and gelatin (1.41 g/m$^2$).

Fast Magenta Dye-forming Layer: This layer comprises a green sensitive, tabular grain, silver bromoiodide emulsion (4.5 mole percent iodide) (0.98 $\mu$m diameter by 0.113 $\mu$m thick) (0.699 g/m$^2$ Ag), compound M-1 (0.052 g/m$^2$), MM-1 (0.032 g/m$^2$), IR-2 (0.022 g/m$^2$), ST-1 (0.005 g/m$^2$), S-1 (0.111 g/m$^2$), S-2 (0.044 g/m$^2$), and gelatin (1.123 g/m$^2$).

Yellow Filter Layer: This layer comprises 2,5-di-t-octyl-1, 4-dihydroxy benzene (0.075 g/m$^2$), YD-2 (0.108 g/m$^2$), Irganox 1076 sold by Ciba-Geigy (0.01 g/m$^2$), S-2 (0.121 g/m$^2$), and gelatin (0.861 g/m$^2$).

Slow Yellow Dye-forming Layer: This layer comprises a blend of a blue sensitive, tabular grain,.silver bromoiodide emulsion (4.5 mole percent iodide) (1.4 $\mu$m diameter by 0.131 $\mu$m thick) (0.161 g/m$^2$ Ag), a blue sensitive, tabular grain, silver bromoiodide emulsion (1.5 mole percent iodide) (0.85 $\mu$m diameter by 0.131 $\mu$m thick) (0.0.108 g/m$^2$ Ag), and a blue sensitive, tabular grain, silver bromoiodide emulsion (1.3 mole percent iodide) (0.54 $\mu$m diameter by 0.086 m thick) (0.161 g/m$^2$ Ag), compound Y-1 (0.915 g/m$^2$), IR-1 (0.032 g/m$^2$), B-1 (0.0065 g/m$^2$), S-1 (0.489 g/m$^2$), S-3 (0.0084 g/m$^2$), and gelatin (1.668 g/m$^2$).

Fast Yellow Dye-forming Laver: This layer comprises a blue sensitive, tabular grain, silver bromoiodide emulsion (4.5 mole percent iodide) (2.3 $\mu$m diameter by 0.128 $\mu$m thick) (0.43 g/m$^2$ Ag), compound Y-1 (0.15 g/m$^2$), IR-1 (0.032 g/m$^2$), B-1 (0.0054 g/m$^2$), S-1 (0.091 g/m$^2$), S-3 (0.0070 g/m$^2$), and gelatin (0.753 g/m$^2$).

Second Protective Layer: Various compositions according to Table 2.

First Protective Layer: Various compositions according to Table 3.

Y1

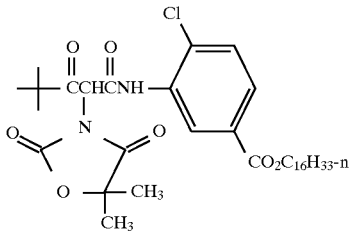

IR-1

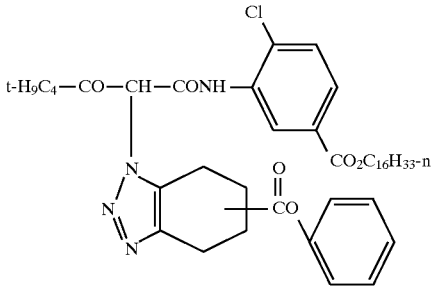

YD-2

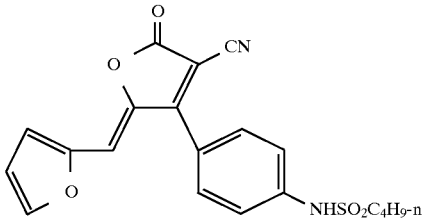

ST-1

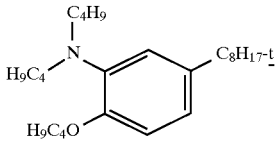

-continued
IR-2
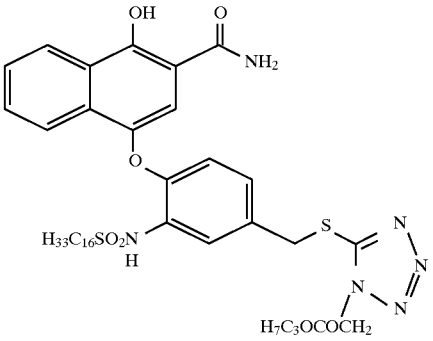
IR-3
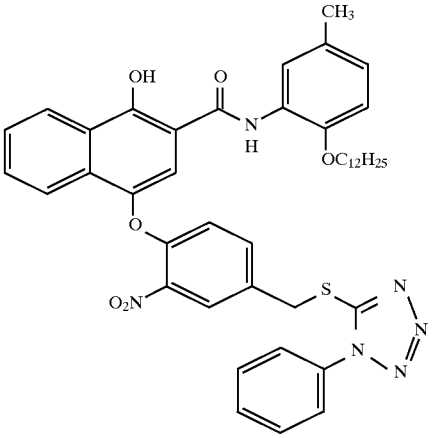
IR-4
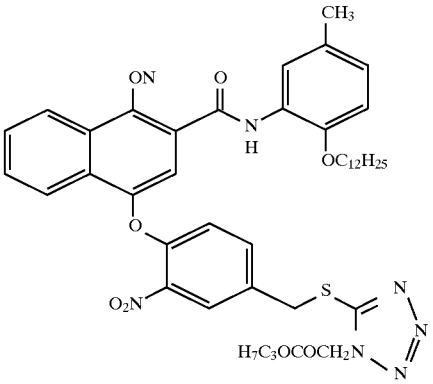
B-1
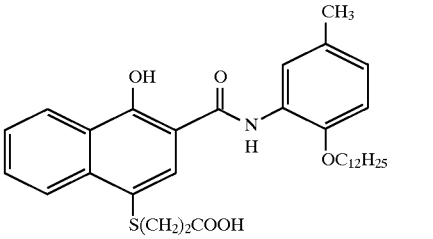

-continued
M-1
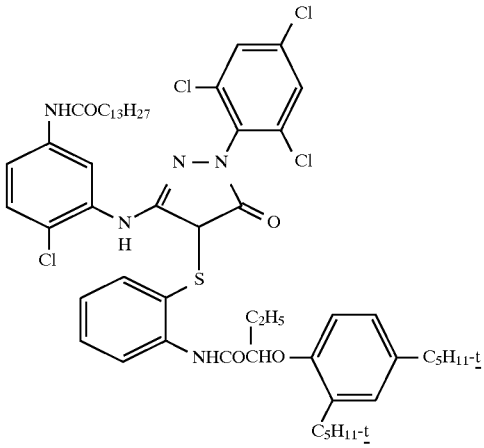
MM-1
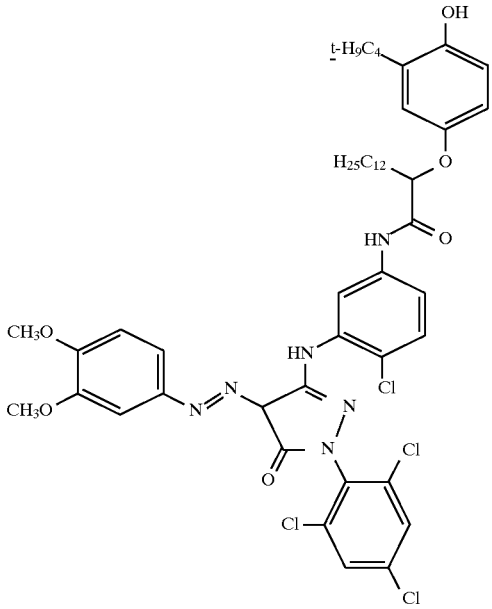
CC-1
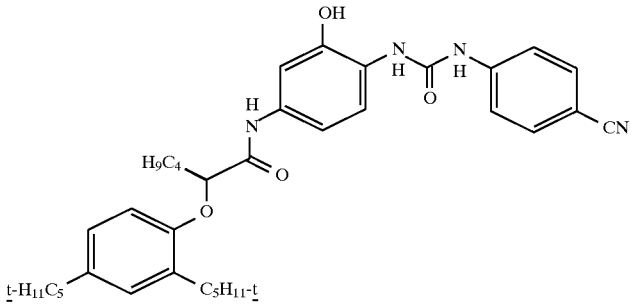

-continued
CM-1
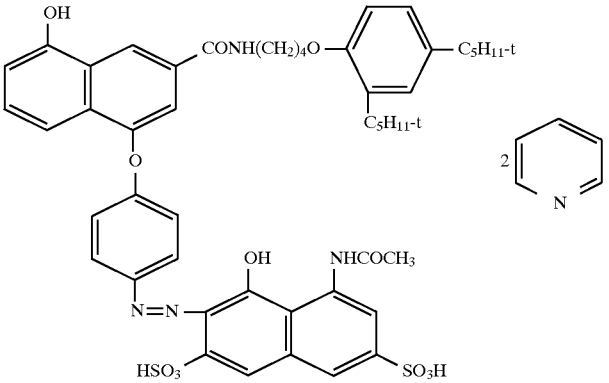
S-1
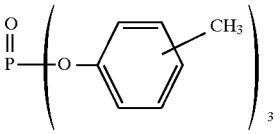
S-2
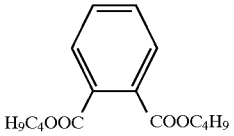
$C_{11}H_{23}CON(C_2H_5)_2$ S-3
S-4
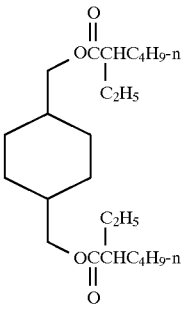
S-5
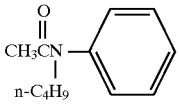
AHU-1
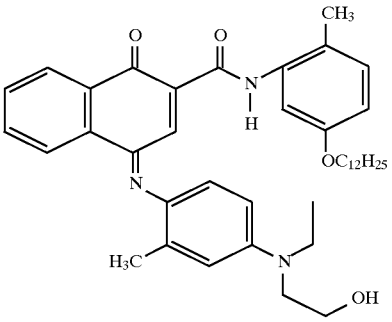

-continued

AHU-2

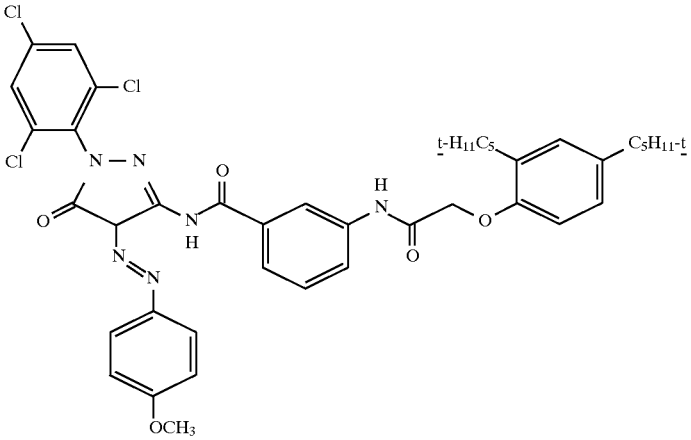

AHU-3

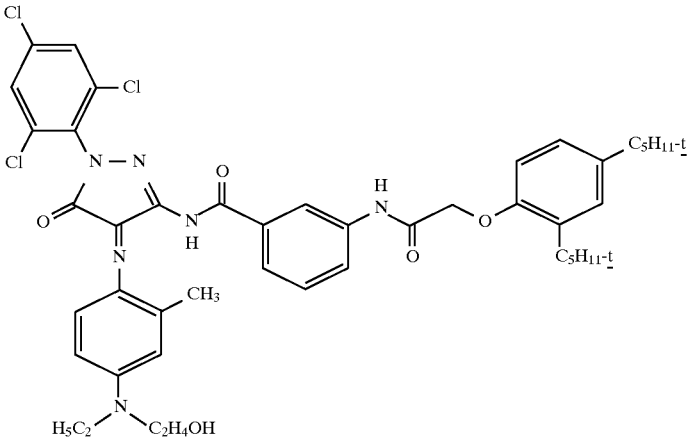

TABLE 2

| Composition of the Second Protective Layer | |
|---|---|
| Gelatin, lime processed | 0.7 g/m$^2$ |
| Colloidal silver | 0.215 g/m$^2$ |
| Ultraviolet ray absorber | Table 4 |

TABLE 3

| Composition of the First Protective Layer | |
|---|---|
| Gelatin, lime processed | 0.888 g/m$^2$ |
| Silicone lube, DC-200 (Dow Corning) | 0.0401 g/m$^2$ |
| Fluorad FC-134 (3M Co.) | 0.0039 g/m$^2$ |
| Aerosol TO (American Cyanamide) | 0.0215 g/m$^2$ |
| Surfactant Olin 10G (Olin Corp.) | 0.0272 g/m$^2$ |
| Poly(methyl methacrylate) matte, 1.5 $\mu$m | 0.0538 g/m$^2$ |
| Poly(methyl methacrylate-co-methacrylic acid) 47/53 wt % 2.7 $\mu$m | 0.107 g/m$^2$ |
| Polymer Particles | Table 4 |

The following polymer particles ansd dispersions are used for preparing the example photographic elements listed in Table 4.

Dispersion-1: Dispersion-1 is prepared by first dissolving Ultraviolet Ray Absorber I and Ultraviolet Ray Absorber II in a high boiling organic solvent, and then dispersing the resultant solutions in an aqueous gelatin solution by a homogenizer at 3500 psi and 45° C.

Dispersion-2: Dispersion-2 is prepared by first dissolving Ultraviolet Ray Absorber I in a high boiling organic solvent, and then dispersing the resultant solutions in an aqueous gelatin solution by a homogenizer at 3500 psi and 45° C.

Dispersion-3: Dispersion-3 is prepared by first dissolving Ultraviolet Ray Absorber II in a high boiling organic solvent, and then dispersing the resultant solutions in an aqueous gelatin solution by a homogenizer at 3500 psi and 45° C.

Polymer-1: Polymer-1 is a poly(methyl methacrylate) particle (102 nm) and is prepared in accordance with the present invention.

Polymer-2: Polymer-2 is a poly(methyl methacrylate-co-ethylene glycol dimethacrylate) (80/20) particle (149 nm) containing with Ultraviolet Ray Absorber I at a polymer to ultraviolet ray absorber ratio of 3 to 1, and is prepared in accordance with the present invention.

TABLE 4

| | First Protective Layer | | Second Protective Layer | |
|---|---|---|---|---|
| Examples | Polymer | mg/m$^2$ | Ultraviolet Ray Absorber | mg/m$^2$ |
| Example 13 (Comparison) | None | — | Dispersion-2/ Dispersion-3 | UV-I: 106 UV-II: 106 HBS: 212 |
| Example 14 (Comparison) | None | — | Dispersion-1 | UV-I: 406 UV-II: 106 HBS: 148 |

TABLE 4-continued

| Examples | First Protective Layer Polymer | First Protective Layer mg/m$^2$ | Second Protective Layer Ultraviolet Ray Absorber | Second Protective Layer Ultraviolet Ray mg/m$^2$ |
|---|---|---|---|---|
| Example 15 (Invention) | Polymer-1 | 323 | Dispersion-1I | UV-I: 106<br>UV-II: 106<br>HBS: 148 |
| Example 16 (Invention) | Polymer-2 | Polymer: 323<br>UV-I: 106 | Dispersion-3 | UV-II: 106<br>HBS: 106 |

*HBS: high boiling organic solvent
UV-I: Ultraviolet Ray Absorber I
UV-II: Ultraviolet Ray Absorber II Taber scratch and abrasion resistance test:

To evaluate the abrasion resistance of the protective overcoat, discs of coatings after processing are placed on a Taber Abrader and abraded in accordance with ASTM method D1044. Since the outermost layer contains matting agents, the measurement based on percentage light transmission or difference in percentage haze (Delta Haze) before and after Taber abrasion cannot be used to measure the abrasion resistance of the coatings. Instead, a Gould Microtopographer 200 is used to measured the surface roughness within the track area of the samples after Taber abrasion. The surface roughness is then analyzed in terms of two parameters: PPCM which counts the number of scratches produced by Taber wheels per centimeter and Ra which accounts for the average surface roughness. The product of the two (Ra×PPCM) is used here to quantify how badly the sample surface is scratched. The larger the Ra×PPCM value, the poorer is the scratch resistance of the sample. The results are summarized in Table 5.

Evaluation of ferrotyping resistance:

A group of six 35 mm strips having a length of 305 mm (12 inches) of the feature film (processed) are placed in a 80% relative humidity (RH) chamber for a minimum of 16 hours. The strips are stacked, sensitized side to unsensitized side and wrapped in foil, placed inside a moisture proof wrap, and sealed. The sealed package is then placed above a flat glass plate and under a brass bar of the same size with weight of 6.89 kgs (15 lbs). The package, with the glass plate and brass bar is then placed in a 37.8° C. (100° F.) room for 17 hours. After storage, the bag is opened, the top and bottom strips are discarded, and the remaining strips are visually inspected for ferrotyping against the following scale:

| Value | % of area showing ferrotyping |
|---|---|
| A | 0 to <5% |
| B | 5 to <20% |
| C | 20 to <50% |
| D | 50 to 100% |

The results are reported in Table 5.

TABLE 5

| Example | Ferrotyping 37.8° C./80% RH | Ra × PPCM |
|---|---|---|
| Example 13 (Comparison) | C | 9.6 |
| Example 14 (Comparison) | C | 4.9 |
| Example 15 (Invention) | A | 3.6 |
| Example 16 (Invention) | A | 3.6 |

The results in Table 5 demonstrate that the photographic elements prepared in accordance with the present invention show excellent resistance to both scratch and ferrotyping.

Examples 17 to 20: Photographic Elements

Examples 17 to 20 are prepared as in Examples 13 to 16 except the first and second protective layers which have compositions shown in Table 6 and 7.

TABLE 6

| Composition of the Second Protective Layer | |
|---|---|
| Gelatin, lime processed | 0.7 g/m$^2$ |
| Colloidal silver | 0.215 g/m$^2$ |
| Ultraviolet ray absorber | Table 8 |

TABLE 7

| Composition of the First Protective Layer | |
|---|---|
| Gelatin, lime processed | 0.888 g/m$^2$ |
| Silicone lube, DC-200 (Dow Corning) | 0.0401 g/m$^2$ |
| Fluorad FC-134 (3M Co.) | 0.0039 g/m$^2$ |
| Aerosol OT (American Cyanamide) | 0.0215 g/m$^2$ |
| Surfactant Olin 10G (Olin Corp.) | 0.0272 g/m$^2$ |
| Poly(methyl methacrylate) matte, 1.5 $\mu$m | 0.0538 g/m$^2$ |
| Poly(methyl methacrylate-co-methacrylic acid) 45/55 wt % 2.7 $\mu$m | 0.107 g/m$^2$ |
| Ultraviolet ray absorbing polymer particle | Table 8 |

Table 8 shows the compositions of the first and second protective layers of each photographic element prepared.

TABLE 8

| Examples | First Protective Layer Polymer | First Protective Layer mg/m$^2$ | Second Protective Layer Ultraviolet Ray Absorber | Second Protective Layer Ultraviolet Ray mg/m$^2$ |
|---|---|---|---|---|
| Example 17 (Comparison) | None | — | Dispersion-2/ Dispersion-3 | UV-I: 106<br>UV-II: 106<br>HBS: 212 |
| Example 18 (Invention) | None | — | Polymer-3 | UV-I: 106<br>UV-II: 106<br>Polymer: 318 |
| Example 19 (Invention) | None | — | Polymer-4 | UV-I: 106<br>UV-II: 106<br>Polymer: 424 |

TABLE 8-continued

| | First Protective Layer | | Second Protective Layer Ultraviolet Ray | |
|---|---|---|---|---|
| Examples | Polymer | mg/m$^2$ | Absorber | mg/m$^2$ |
| Example 20 (Invention) | Polymer-1 | 323 | Polymer-4 | UV-I: 106 UV-II: 106 Polymer: 424 |

Polymer-3: Polymer-3 is a poly(ethyl methacrylate) particle (155 nm) impregnated with Ultraviolet Ray Absorber I and Ultraviolet Ray Absorber II (polymer:Ultraviolet Ray Absorber I: Ultraviolet Ray Absorber II = 3:1:1), and is prepared in accordance with the present invention.
Polymer-4: Polymer-4 is a poly(ethyl methacrylate) particle (152 nm) impregnated with Ultraviolet Ray Absorber I and Ultraviolet Ray Absorber II (polymer:Ultraviolet Ray Absorber I: Ultraviolet Ray Absorber II = 4:1:1), and is prepared in accordance with the present invention.

Taber scratch and abrasion resistance test:

To evaluate the abrasion resistance of the protective overcoat, discs of coatings after processing are placed on a Taber Abrader and abraded in accordance with ASTM method D1044. Since the outermost layer contains matting agents, the measurement based on percentage light transmission or difference in percentage haze (Delta Haze) before and after Taber abrasion cannot be used to measure the abrasion resistance of the coatings. Instead, a Gould Microtopographer 200 is used to measured the surface roughness within the track area of the samples after Taber abrasion. The surface roughness is then analyzed in terms of two parameters: PPCM which counts the number of scratches produced by Taber wheels per centimeter and Ra which accounts for the average surface roughness. The product of the two (Ra×PPCM) is used here to quantify how badly the sample surface is scratched. The larger the Ra×PPCM value, the poorer is the scratch resistance of the sample. The results are summarized in Table 9.

TABLE 9

| Example | Ra × PPCM |
|---|---|
| Example 17 (Comparison) | 9.6 |
| Example 18 (Invention) | 2.8 |
| Example 19 (Invention) | 2.8 |
| Example 20 (Invention) | 3.9 |

The above examples show that all the photographic elements that are prepared according to the present invention show excellent resistance to scratch and abrasion.

The invention has been described in detail with particular reference to certain preferred embodiments thereof, but it will be understood that variations and modifications can be effected within the spirit and scope of the invention.

What is claimed is:

1. A method of making a photographic element comprising:

providing a support having thereon at least one silver halide emulsion layer;

mechanically forming droplets having a size less than 250 nm of an ethylenically unsaturated monomer and hydrophobic groups, the hydrophobic groups having a $\log P_{(calc)}$ greater than a $\log P_{(calc)}$ of the ethylenically unsaturated monomer by at least 1 unit; and polymerizing said droplets so that the polymerized droplets have a size of less than 250 nm, coating said polymerized droplets with a binder on said support;

drying said polymerized droplets and binder to form a layer.

2. The method of claim 1 wherein the hydrophobic groups comprise at least about 0.01 weight percent of ethylenically unsaturated monomer.

3. The method of claim 1 wherein the hydrophobic groups are selected from the group consisting of alkanes, alkenes, substituted aromatic compounds, haloalkanes, methyl laurate, butyl laurate, methyl oleate, butyl oleate, methyl stearate, isopropyl palmitate, isopropyl stearate, tributyl citrate, acetyl tributyl citrate, dioctyl terephthalate, dibutyl sebacate, didecyl succinate, bis(2-ethylhexyl) azelate, lauramide, N-methyllauramide, N,N-dimethyllauramide, N,N-dibutyllauramide, N-decyl-N-methylacetamide, N-oleylphthalimide, sulfates, sulfonates, sulfonamides, sulfoxides, phosphates, phosphonates, phosphinates, phosphites, and phosphine oxides.

4. The method of claim 1 wherein the ethylenically unsaturated monomer is selected from the group consisting of alkyl esters of acrylic acid, alkyl esters of methacrylic acid, hydroxyalkyl esters of acrylic acid, hydroxyalkyl esters of methacrylic acid, nitriles of acrylic acid, nitriles of methacrylic acid, amides of acrylic acid, amides of methacrylic acid, vinyl acetate, vinyl propionate, vinylidene chloride, vinyl chloride, styrene, t-butyl styrene, ethyl vinyl benzene, vinyl toluene, dialkyl maleates, dialkyl itaconates, dialkyl malonates, isoprene, and butadiene.

5. The method of claim 1 wherein the droplets further comprise crosslinking or grafting monomers selected from the group consisting of, esters of unsaturated monohydric alcohols with unsaturated monocarboxylic acids, esters of saturated glycols with unsaturated monocarboxylic acids, esters of diols with unsaturated monocarboxylic acids, and divinyl benzene.

6. The method of claim 1 wherein the polymerizing step is initiated with a free radical initiator selected from the group consiting of persulfates, peroxides, azo compounds, and redox initiators.

7. The method of claim 6 wherein the free radical initiator is present in an amount of from 0.01% to 2% by the weight of monomer.

8. The method of claim 1 wherein the polymerizing step is carried out in the presence of gelatin.

9. The method of claim 1 wherein the support is selected from the group consisting of papers, glass, acetate polymers and polyesters.

10. The method of claim 1 wherein the photographic element further comprises an undercoat or subbing layer.

11. The method of claim 1 wherein the binder is selected from the group consisting of polyurethanes, cellulose acetates, poly(methyl methacrylate), polyesters, polyamides, polycarbonates, polyvinyl acetate, proteins, protein derivatives, cellulose derivatives, polysaccharides, poly(vinyl lactams), acrylamide polymers, poly(vinyl alcohol), derivatives of poly(vinyl alcohol), hydrolyzed polyvinyl acetates, polymers of methacrylates, polymers of alkyl acrylates, polymers of sulfoalkyl acrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl sulfonic acid copolymers, vinyl imidazole copolymers, vinyl sulfide copolymers, homopolymer containing styrene sulfonic acid, copolymers containing styrene sulfonic acid, and gelatin.

12. The method of claim 1 wherein the step of polymerizing said droplets is in the presence of a dispersing agent.

13. The method of claim 12 wherein the dispersing agent is selected from the group consisting of sodium dodecyl sulfate, sodium dioctylsulfosuccinate, polyvinyl alcohol, methyl cellulose, methyl hydroxypropyl cellulose , ethyl cellulose sodium salt of carboxymethyl cellulose, polyacrylic acid and salts thereof, starch, gum, alginic acid, zein, and casein.

14. The method of claim 1 wherein said support further has thereon at least one electrically conductive layer.

15. A method of making a photographic element comprising:

providing a support having thereon at least one silver halide emulsion layer; and mechanically forming droplets having a size less than 250 nm of an ethylenically unsaturated monomer having a $\log P_{(calc)}$ greater than 4; and polymerizing said droplets so that the polymerized droplets have a size of less than 250 nm coating said polymerized droplets and a binder on the support drying said polymerized droplets and binder to form a layer.

16. The method of claim 15 wherein the ethylenically unsaturated monomer is selected from the group consisting of alkyl esters of acrylic acid, alkyl esters of methacrylic acid, hydroxyalkyl esters of acrylic acid, hydroxyalkyl esters of methacrylic acid, nitriles of acrylic acid, nitriles of methacrylic acid, amides of acrylic acid, amides of methacrylic acid, vinylidene chloride, t-butyl styrene, dialkyl maleates, dialkyl itaconates, and dialkyl malonates.

17. The method of claim 15 wherein the droplets further comprise crosslinking or grafting monomers selected from the group consisting of, esters of unsaturated monohydric alcohols with unsaturated monocarboxylic acids, esters of saturated glycols with unsaturated monocarboxylic acids, esters of diols with unsaturated monocarboxylic acids, and divinyl benzene.

18. The method of claim 15 wherein the polymerizing step is initiated with a free radical initiator selected from the group consisting of persulfates, peroxides, azo compounds, and redox initiators.

19. The method of claim 18 wherein the free radical initiator is present in an amount of from 0.01% to 2% by the weight of monomer.

20. The method of claim 15 wherein the polymerizing step is carried out in the presence of gelatin.

21. The method of claim 15 wherein the support is selected from the group consisting of papers, glass, acetate polymers and polyesters.

22. The method of claim 15 wherein the photographic element further comprises an undercoat or subbing layer.

23. The method of claim 15 wherein the binder is selected from the group consisting of polyurethanes, cellulose acetates, poly(methyl methacrylate), polyesters, polyamides, polycarbonates, polyvinyl acetate, proteins, protein derivatives, cellulose derivatives, polysaccharides, poly(vinyl lactams), acrylamide polymers, poly(vinyl alcohol), derivatives of poly(vinyl alcohol), hydrolyzed polyvinyl acetates, polymers of methacrylates, polymers of alkyl acrylates, polymers of sulfoalkyl acrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl sulfonic acid copolymers, vinyl imidazole copolymers, vinyl sulfide copolymers, homopolymer containing styrene sulfonic acid, copolymers containing styrene sulfonic acid, and gelatin.

24. The method of claim 15 wherein the step of polymerizing said droplets is in the presence of a dispersing agent.

25. The method of claim 24 wherein the dispersing agent is selected from the group consisting of sodium dodecyl sulfate, sodium dioctylsulfosuccinate, polyvinyl alcohol, methyl cellulose, methyl hydroxypropyl cellulose, ethyl cellulose sodium salt of carboxymethyl cellulose, polyacrylic acid and salts thereof, starch, gum, alginic acid, zein, and casein.

26. The method of claim 16 wherein said support further has thereon at least one electrically conductive layer.

* * * * *